US005466305A

United States Patent [19]

Sato et al.

[11] Patent Number: 5,466,305

[45] Date of Patent: Nov. 14, 1995

[54] METHOD OF TREATING THE SURFACE OF TITANIUM

[75] Inventors: Yukihiro Sato, Amagasaki; Takumi Sone, Osaka; Sachio Nagata, Takarazuka; Tetsuhiro Sakata; Kei Demizu, both of Suita; Shinichi Tanaka, Osaka, all of Japan

[73] Assignees: Tanaka Limited; Osaka Prefecture, both of Osaka, Japan

[21] Appl. No.: 307,447

[22] Filed: Sep. 21, 1994

[30] Foreign Application Priority Data

Sep. 21, 1993 [JP] Japan ..... 5-234735

[51] Int. Cl.[6] ..... C23C 8/36

[52] U.S. Cl. ..... 148/222; 148/237; 427/450; 427/457; 427/530

[58] Field of Search ..... 148/206, 222, 148/237; 427/457, 458, 530

[56] References Cited

U.S. PATENT DOCUMENTS

| | | | |
|---|---|---|---|
| 3,988,955 | 11/1976 | Engel et al. | 148/222 |
| 4,394,234 | 7/1983 | Asahi et al. | 148/222 |
| 4,402,994 | 9/1983 | Kobayashi et al. | 427/530 |
| 4,762,756 | 8/1988 | Bergmann et al. | 427/530 |
| 4,900,371 | 2/1990 | Dexter et al. | 148/222 |
| 5,260,107 | 11/1993 | Kawamura et al. | 427/577 |

FOREIGN PATENT DOCUMENTS

| | | | |
|---|---|---|---|
| 2446327 | 8/1980 | France | 148/222 |
| 3038026 | 5/1981 | Germany | 148/222 |
| 0213459 | 8/1990 | Japan | 148/222 |
| 6108139 | 4/1994 | Japan | 148/222 |

*Primary Examiner*—John Sheehan
*Attorney, Agent, or Firm*—Wenderoth, Lind & Ponack

[57] ABSTRACT

The surface of titanium is treated to reduce the friction coefficient and wear loss without sacrificing its corrosion resistance. Pure titanium or titanium alloy is subjected to plasma-carburizing in an atmosphere containing hydrocarbon gas at a pressure of 0.5 to 15 Torr and a temperature of 700° to 1100° C.

2 Claims, 4 Drawing Sheets

PURE Ti VS. PURE Ti

PURE Ti VS. PURE Ti

Ti ALLOY VS. Ti ALLOY

PURE Ti VS. BEARING STEEL

Ti ALLOY VS. BEARING STEEL

METHOD OF TREATING THE SURFACE OF TITANIUM

BACKGROUND OF THE INVENTION

This invention relates to a method of treating the surface of titanium.

Titanium has a high heat resistance and a strength matching carbon steel. It also exhibits excellent corrosion resistance by forming an oxide layer on the surface.

Pure titanium can be alloyed with any metal, particularly with copper, tin, iron, aluminum, vanadium, chromium, cobalt, molybdenum and tungsten. Thus, it is possible to improve its workability and mechanical strength within a wide range.

Pure titanium or its alloys are used as materials for corrosion-resistant containers and rims for glasses, and medical and dental parts.

Although titanium has high corrosion resistance, mechanical strength and other favorable properties, there is still room for improvement as materials used for sliding contact with other materials.

Namely, the friction coefficient and wear resistance of titanium are not sufficient for use as sliding parts or fastening parts such as bolts and nuts.

It is an object of this invention to reduce the friction coefficient and wear loss of titanium without sacrificing its corrosion resistance.

SUMMARY OF THE INVENTION

In order to achieve this object, according to this invention, titanium is subjected to plasma-carburizing treatment in an atmosphere containing hydrocarbon gas and kept at a pressure of 0.5–15 Torr and at a temperature of 700°–1100° C.

The titanium used in this invention may be pure titanium or an alloy of titanium and other metal. If it is an alloy, there is no limitation in its composition. It is also possible to use commercially available pure titanium whose purity is about 99.9–99.5%.

Since titanium can be alloyed with any metal, there is no limitation in the kinds of metal contained in the alloy. For example, titanium may be alloyed with copper, tin, iron, aluminum, vanadium, chromium, cobalt, molybdenum or tungsten.

Before subjecting titanium to plasma-carburizing, it is preferably immersed in an organic solvent or its surface is subjected to ultrasonic cleaning.

Such a plasma-carburizing may be carried out using a conventional carburizing apparatus (e.g. made by Japan Electronic Industry) which comprises a heating furnace having a treating chamber enclosed by heat insulating material such as graphite fiber, a heater of rod graphite for heating the treating chamber, a DC glow-discharge anode connected to an upper position of the treating chamber, a cathode connected to a table on which the material to be treated is placed, and gas manifolds mounted in the treating chamber to introduce a processing or cleaning gas such as hydrocarbon, nitrogen, argon or hydrogen in a dispersed state.

According to the present invention, titanium is subjected to plasma-carburizing in the following manner.

Titanium is put in the treating chamber and the chamber is evacuated; the chamber is heated to a carburizing temperature of 700°–1100° C. by the heater; a diluting or cleaning gas such as hydrogen, argon or nitrogen is introduced into the chamber, and a DC voltage of 200–1500 V is applied and held for 10–30 minutes.

The gas introduced into the treating chamber turns into a plasma whose potential is substantially uniform at any parts in the chamber from its anode to cathode. But its potential drops sharply near the cathode. Thus, the hydrogen ions $H^+$ and argon ions $Ar^+$ in the plasma are accelerated due to the cathode drop and bombard the titanium surface, thus eliminating oxides and any other contamination adhering to the surface. The surface of the titanium is thus cleaned.

Then, by introducing a hydrocarbon gas such as methane gas into the chamber under the pressure of 0.5–15 Torr, activated carbon ions $C^+$ are produced in the plasma. Carburizing reaction proceeds as the carbon ions sticking to the titanium surface diffuse into titanium or by sputtering or driving the carbon ions.

The hydrocarbon gas used in this invention may be any type of methane homolog represented by $C_nH_{2n+2}$, provided it is in a gaseous form at the carburizing temperature. Methane, ethane, propane and butane are especially preferable because they keep gaseous form at normal temperatures and thus require no gasifying equipment when put to use.

During the plasma-carburizing, the pressure of the hydrocarbon gas should be kept at 0.5–15 Torr to form a layer mainly composed of TiC on the surface of titanium. If the pressure is less than 0.5 Torr, the amount of carbon in the surface layer is too small to improve the sliding properties of the titanium. At more than 15 Torr, the amount of carbon in the carburized layer would reach a saturation value, so that the carburizing effect would not increase any further. Such a high pressure is thus impractical.

The temperature of the atmosphere in which the plasma-carburizing according to this invention is carried out should be between 700° and 1100° C. If less than 700° C., sooting is likely to occur on the surface of the titanium. This leads to an increase in the partial pressure of the diluting gas (such as hydrogen, argon or nitrogen) and thus an extreme drop in the treating efficiency. At 950° C., titanium would transform from the hexagonal system (α type) to the isometric system (β type), so that its properties will change. If higher than 1100° C., the strength of the material would impair and thus such a temperature is not practical.

As will be seen from the Examples, the treating time may be determined according to the ambient temperature, kind and concentration of gas and treating pressure. For example, the treating time may be about one hour if the ambient temperature is 950° C., the gas is 100% propane and the treating pressure is 1Torr. Of course, it may be adjusted according to the titanium or its alloy to be treated and the intended use, in order to achieve a required mechanical strength.

According to the method of the present invention, titanium is subjected to plasma-carburizing at a predetermined pressure and temperature. During this process, one or more of the following phenomena occurs: Namely, activated carbon ions stick to the surface of titanium; Ti atoms that have detached from the titanium surface are combined with activated carbon ions, stick to the surface of titanium and diffuse into it; or carbon ions which have been accelerated near the cathode are directly driven into the titanium surface. A surface layer composed mainly of titanium carbide is thus formed on the titanium surface.

The carbide contained in the surface layer thus formed presumably serves to improve the lubricity of the surface layer and thus to lower the wear and friction coefficient of titanium without lowering its corrosion resistance. The surface layer can be made fairly thick, e.g. about 70 μm. Such a thick surface layer is sufficiently durable.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

EXAMPLE 1

A flat plate of pure titanium 25 mm wide, 35 mm long and 3 mm thick (made by Kobe Steel Works, Ltd.) was polished at 240 emery, ultrasonic-cleaned in acetone, and subjected to plasma-carburizing using the device and under the conditions mentioned below.

Namely, we used a known carburizing apparatus (made by Japan Electronic Industry) which comprises a heating furnace having a treating chamber enclosed by heat insulating material such as graphite fiber, a heater of rod graphite for heating the treating chamber, a DC glow-discharge anode connected to the upper position of the treating chamber, a cathode connected to a table for placing the material to be treated, and gas manifolds mounted in the treating chamber to introduce a processing gas such as hydrocarbon, nitrogen, argon or hydrogen.

The carburizing was conducted in an atmosphere of 100% propane gas kept at 1 Torr and 950° C. for one hour. After the treatment, nitrogen gas was introduced under pressure into the treating chamber to cool the interior of the chamber to normal temperature.

The titanium thus treated was observed by X-ray diffraction and with an optical microscope to examine and measure the crystal structure and thickness of the surface layer formed on the titanium, and subjected to a friction/wear test.

Figure 2A:
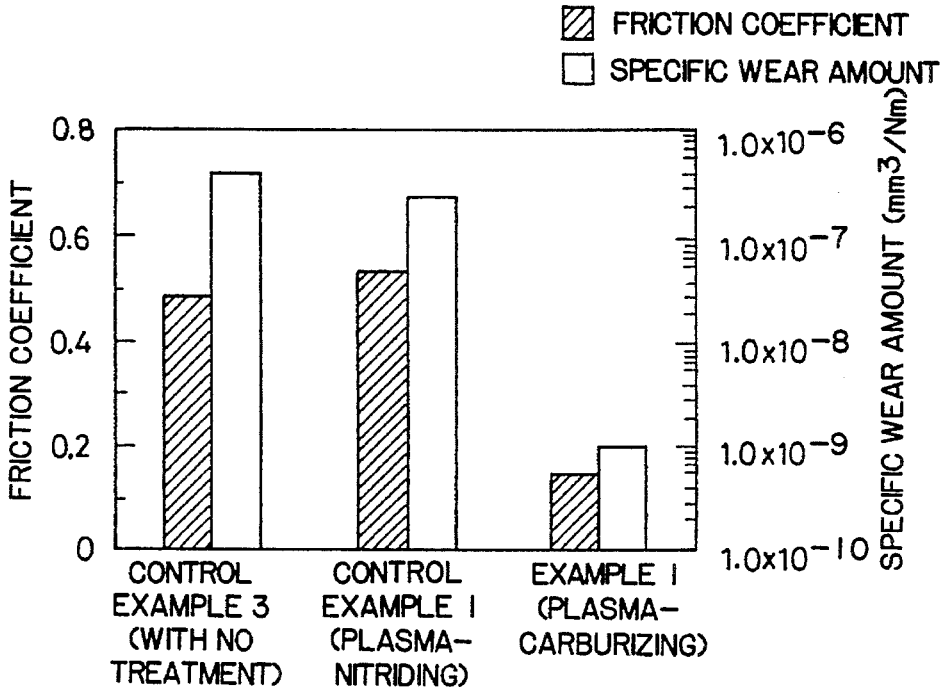
FIG. 2A is a graph showing the friction coefficient and the specific wear amount when rubbing two test pieces together which are formed from each of Example 1, Control Example 1 and Control Example 3.
Figure 3A:
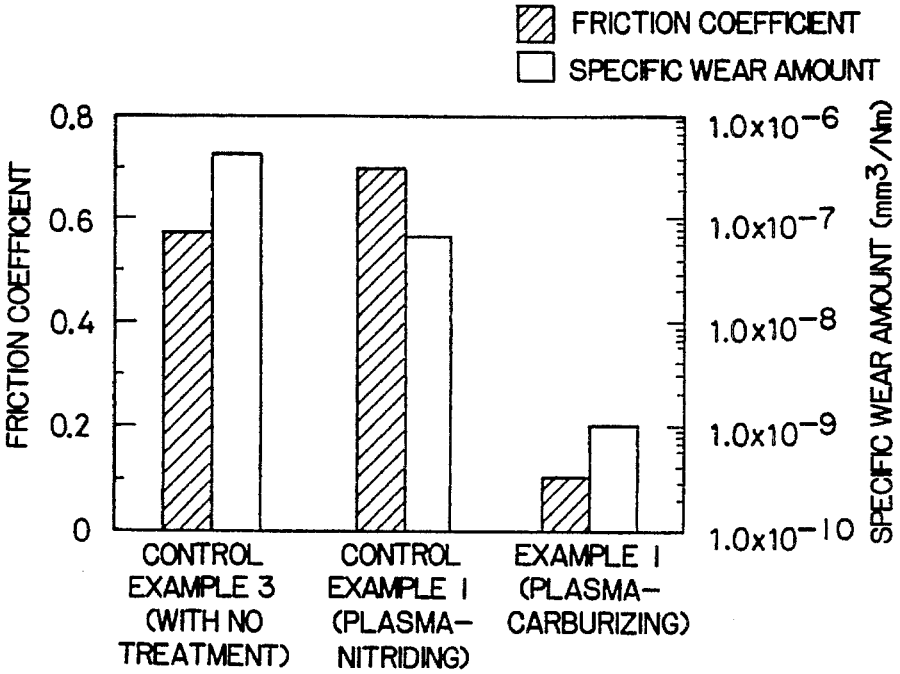
FIG. 3A is a graph showing the friction coefficient and the specific wear amount when a test piece formed from each of Example 1, Control Example 1 and Control Example 3 is rubbed against a bearing material.

The friction/wear test was conducted using the device and under the conditions shown below. The test results are shown in FIGS. 2A and 3A.

Namely, a pin as mating material (made of bearing steel: SUSJ2 or the same material as the test piece) was fixed to the lower side of one end of an arm which was supported so that a load of 1.96N acts on the one end by a counterweight. With the mating material pressed against the flat test piece under the load mentioned above, the test piece was reciprocated forcibly in a direction transverse to the longitudinal direction of the arm at the speed of 20 mm/sec and at the stroke of 5 mm. To measure the frictional force acting between the mating material and the test piece, the strain that acts on the arm while moving the test piece was measured with a strain gauge. The strain thus measured was inputted in a computer through an A/D converter to calculate the friction coefficient.

Figure 4:
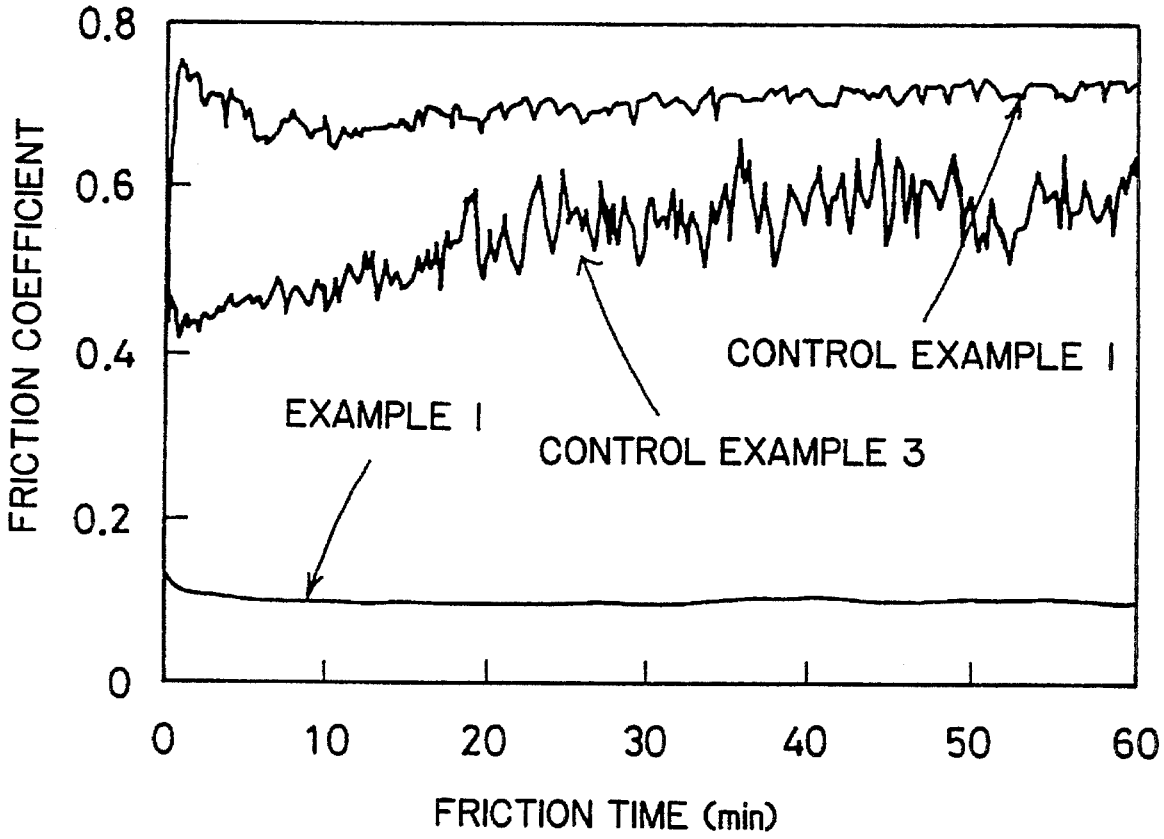
FIG. 4 is a graph showing the relation between the time during which each of Example 1, Control Example 1 and Control Example 3 is rubbed against a bearing steel and its friction coefficient.

In this test, the test piece was subjected to friction for two hours in the atmosphere kept at room temperature with the relative humidity of 50–60%. The friction coefficient was measured continuously for 60 minutes from the beginning of the testing to examine its change. The results are shown in FIG. 4.

As for wear properties, we examined the sectional shape of the wear impression on the test piece with a surface roughness gauge and measured the specific wear amount ($mm^3/Nm$) after the testing by calculating the wornout weight or volume from the difference in weight of the test piece before and after the testing.

EXAMPLE 2

Figure 2B:
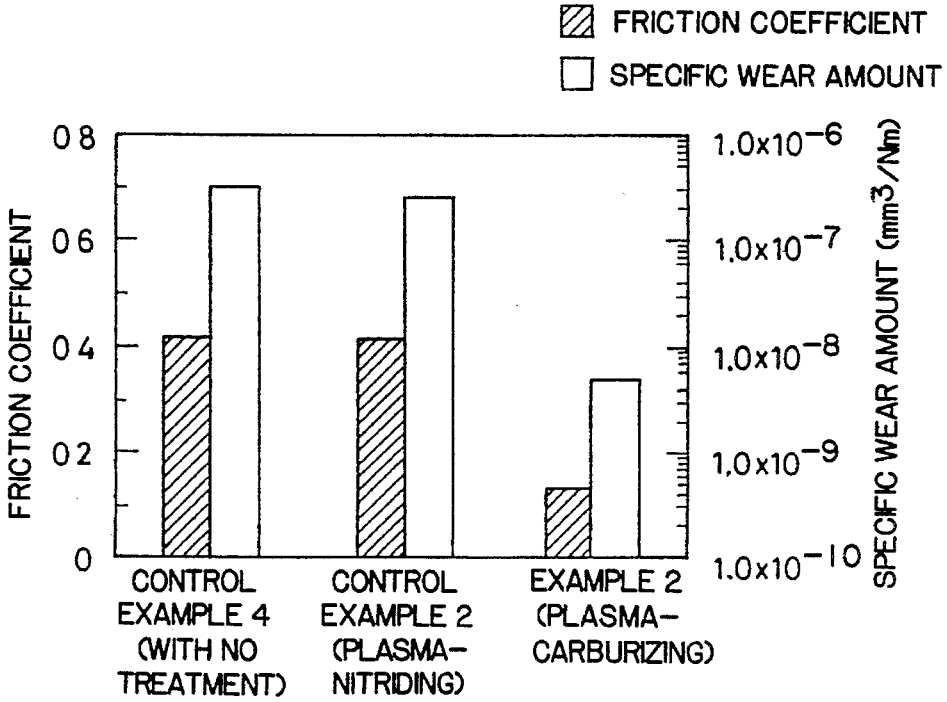
FIG. 2B is a graph showing the friction coefficient and the specific wear amount when two test pieces formed from each of Example 2, Control Example 2 and Control Example 4 are rubbed together.
Figure 3B:
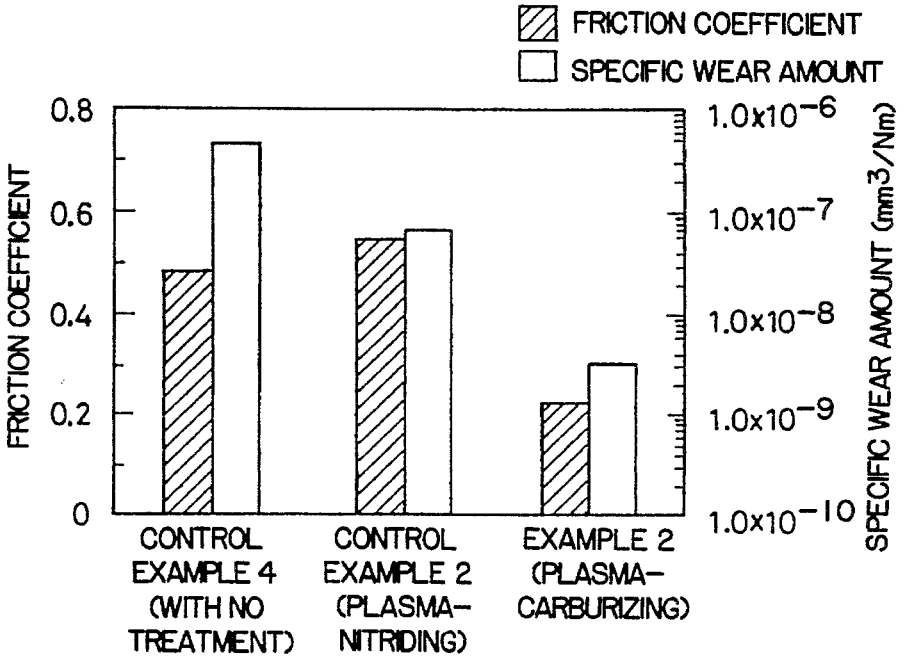
FIG. 3B is a graph showing the friction coefficient and the specific wear amount when a test piece formed from each of Example 2, Control Example 2 and Control Example 4 is rubbed against a bearing material.

A test piece was manufactured by plasma-carburizing under exactly the same conditions as in Example 1 except that the titanium alloy used (Ti-6Al-4V) (made by Kobe Steel Works, Ltd., same dimensions) was different from that used in Example 1. The same experiments as in Example 1 were conducted on this test piece. The results are shown in FIGS. 2B and 3B.

Figure 1:
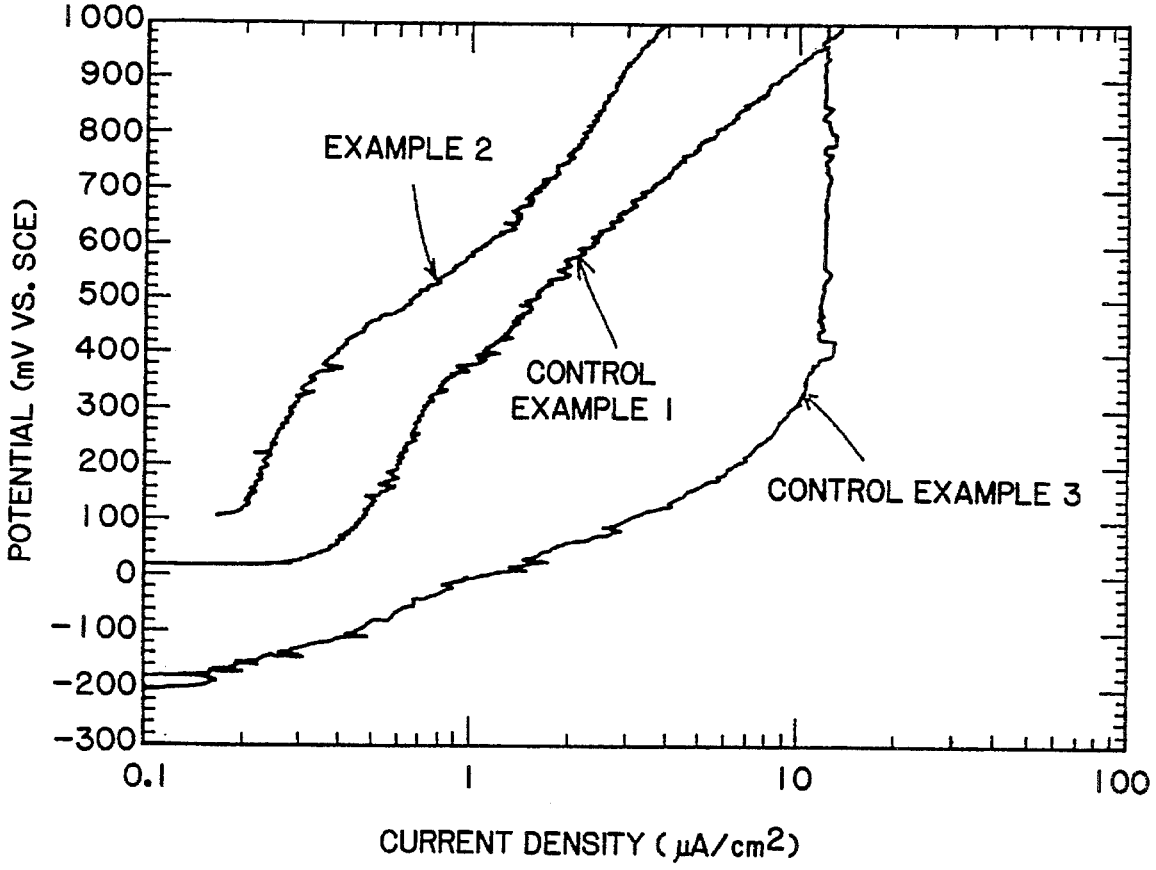
FIG. 1 is a graph showing the relation between the current density and the potential as measured with a potentiostat.

In Example 2, we also compared corrosion resistance using a potentiostat. Namely, we measured the relation between the current density ($\mu A/cm^2$) and potential (mV vs.SCE) in a 3 wt % sodium chloride solution at 21° C. with no ventilation. The results are shown in FIG. 1.

CONTROL EXAMPLE 1

A test piece was manufactured in the same manner as in Example 1 except that plasma-nitriding was carried out instead of plasma-carburizing. The same experiments as in Example 1 were conducted on this test piece. The results are shown in FIGS. 2A, 3A and 4.

In Control Example 1, we also compared corrosion resistance using a potentiostat. The results are shown in FIG. 1.

The plasma nitriding was conducted in an atmosphere of 100% nitrogen gas kept at 2 Torr and 790° C. for three hours. After the treatment, the test piece was cooled to normal temperature in the furnace.

CONTROL EXAMPLE 2

A test piece was manufactured in the same manner as in Example 2 except that plasma-nitriding was carried out instead of plasma-carburizing (under the same conditions as in Control Example 1). The same experiments were conducted on this test piece. The results are shown in FIGS. 2B and 3B.

CONTROL EXAMPLE 3

A test piece was manufactured from pure titanium (made by Kobe Steel Works Ltd.). The same experiments as in Example 1 were conducted on this test piece (with no surface treatment applied). The results are shown in FIGS.

2A, 3A and 4.

In Control Example 3, we also compared corrosion resistance using a potentiostat. The results are shown in FIG. 1.

CONTROL EXAMPLE 4

A test piece was manufactured from a titanium alloy (Ti-6Al-4V) (made by Kobe Steel Works Ltd.). The same experiments as in Example 1 were conducted on this test piece (with no surface treatment applied). The results are shown in FIGS. 2B and 3B.

Next, we will discuss the experiment results for Examples and Control Examples.

First, as to the crystal structure and thickness of the surface layer as observed by X-ray diffraction and with an optical microscope, it was observed that for Ti alloy: $Ti_2N$>TiN, and for pure Ti:TiN>$Ti_2N$. The thickness of the carburized layer formed on pure titanium and titanium alloy was 70 μm. Clear carburized layer was formed on the pure titanium. But the carburized layers formed on those made of a titanium alloy were somewhat obscure due to the development of diffused layers. These surface layers were mainly composed of TiC.

As is apparent from FIG. 1, which shows the results of the comparison test in which the corrosion resistance was compared using a potentiostat, Example 2, which was formed by subjecting a titanium alloy to plasma-carburizing, was higher in potential and smaller in current and showed better corrosion resistance than Control Example 1, which was formed by subjecting a titanium alloy to plasma-nitriding, or Control Example 3, which is untreated pure titanium.

Also, as is apparent from FIGS. 2 and 3, which show the results of friction/wear test, the friction/wear properties of Control Examples 1 and 2, which were formed by subjecting pure titanium or its alloy to plasma-nitriding, were no better than Control Example 3, which was untreated pure titanium, or Control Example 4, which was an untreated titanium alloy.

This is presumably because the nitrided layers of Control Examples are peeled off or worn out at the initial stage of rubbing because these layers are very thin, and after the nitrided layers have disappeared, the matrix itself is rubbed against the mating material.

In contrast, Example 1, which was formed by subjecting pure titanium to plasma-carburizing, and Example 2, which was formed by subjecting a titanium alloy to plasma-carburizing, were fairly low both in the friction coefficient and the specific wear amount both when the treated test pieces formed in each Example were rubbed against each other (FIG. 2) and when these test pieces were rubbed against mating materials made of a bearing steel (FIG. 3). In short, they revealed improved friction/wear properties.

Also, as will be apparent from the results of FIG. 4, the titanium having their surface treated with plasma-carburizing were not only low in friction coefficient but showed the friction coefficient changing very little with time.

What is claimed is:

1. A method of treating the surface of titanium comprising:

placing titanium in an atmosphere containing a surface cleaning gas to remove oxides on the titanium surface and subjecting the titanium to plasma-carburizing in an atmosphere containing hydrocarbon gas at a pressure of 0.5–15 Torr and a temperature of 700°–1100° C.

2. A method according to claim 1, wherein the surface cleaning gas is a gas selected from the group consisting of hydrogen, argon and nitrogen.

* * * * *